US007804251B2

(12) United States Patent
Wang

(10) Patent No.: US 7,804,251 B2
(45) Date of Patent: Sep. 28, 2010

(54) LED SIGNALING APPARATUS WITH INFRARED EMISSION

(75) Inventor: Sean Xiaolu Wang, Wilmington, DE (US)

(73) Assignee: BWT Property Inc., Newark, DE (US)

( * ) Notice: Subject to any disclaimer, the term of this patent is extended or adjusted under 35 U.S.C. 154(b) by 592 days.

(21) Appl. No.: 11/733,746

(22) Filed: Apr. 10, 2007

(65) Prior Publication Data

US 2009/0115336 A1 May 7, 2009

Related U.S. Application Data

(60) Provisional application No. 60/767,488, filed on Apr. 10, 2006.

(51) Int. Cl.
*H01J 7/42* (2006.01)

(52) U.S. Cl. ..... 315/133; 315/129; 315/185 R

(58) Field of Classification Search ..... 315/185 R, 315/32, 33, 51, 72, 74, 112, 209 R, 291, 312, 315/129, 130, 131, 132, 133, 134, 136; 362/551, 362/552, 555, 559, 560, 570, 576, 577, 580, 362/581, 582, 84, 85, 135–40, 145, 153, 362/154, 15, 227, 234, 249, 251, 252, 253, 362/362, 363, 373, 375, 382, 383, 800
See application file for complete search history.

(56) References Cited

U.S. PATENT DOCUMENTS

| | | | |
|---|---|---|---|
| 3,866,032 | A | 2/1975 | Veres |
| 4,034,480 | A | 7/1977 | Mehrtens |
| 4,064,424 | A | 12/1977 | Hergenrother |
| 4,183,078 | A | 1/1980 | Kidd |
| 4,430,695 | A | 2/1984 | Payne et al. |
| 4,532,512 | A | 7/1985 | Tanner |
| 5,139,334 | A | 8/1992 | Clarke et al. |
| 5,224,773 | A | 7/1993 | Arimura |
| 5,287,104 | A | 2/1994 | Shemwell |
| 5,377,683 | A | 1/1995 | Barken |
| 5,608,290 | A | 3/1997 | Hutchisson |
| 5,655,308 | A | 8/1997 | McDermott |
| 5,804,829 | A | 9/1998 | Palmer |
| 5,967,984 | A | 10/1999 | Chu et al. |
| 5,982,484 | A | 11/1999 | Clarke et al. |
| 6,007,219 | A | 12/1999 | O'Meara |
| 6,030,099 | A | 2/2000 | McDermott |
| 6,048,083 | A | 4/2000 | McDermott |
| 6,086,220 | A | 7/2000 | Lash et al. |
| 6,100,975 | A | 8/2000 | Smith et al. |
| 6,135,994 | A | 10/2000 | Chernoff |
| 6,168,294 | B1 | 1/2001 | Erni et al. |
| 6,224,216 | B1 | 5/2001 | Parker et al. |
| 6,354,714 | B1 | 3/2002 | Rhodes |
| 6,446,467 | B1 | 9/2002 | Lieberman et al. |
| 6,464,373 | B1 | 10/2002 | Petrick |
| 6,489,733 | B1 | 12/2002 | Schmidt et al. |
| 6,543,911 | B1 | 4/2003 | Rizkin et al. |

(Continued)

*Primary Examiner*—Douglas W Owens
*Assistant Examiner*—Jianzi Chen
(74) *Attorney, Agent, or Firm*—Frank F. Tian

(57) ABSTRACT

An infrared signaling apparatus is disclosed, which utilizes high intensity solid state lighting elements, such as light emitting diodes (LEDs) to provide signaling for navigational as well as search/rescue applications employing night vision equipments.

24 Claims, 3 Drawing Sheets

U.S. PATENT DOCUMENTS

| | | | | |
|---|---|---|---|---|
| 6,563,854 | B2 | 5/2003 | Tedesco et al. | |
| 6,688,755 | B2 | 2/2004 | O'Meara | |
| 6,753,762 | B1 | 6/2004 | Gonzalez | |
| 6,902,291 | B2 | 6/2005 | Rizkin et al. | |
| 6,905,228 | B1 | 6/2005 | Takeyasu et al. | |
| 6,932,496 | B2 | 8/2005 | Rizkin et al. | |
| 6,947,571 | B1 | 9/2005 | Rhoads et al. | |
| 7,021,801 | B2 | 4/2006 | Mohacsi | |
| 7,378,983 | B2 * | 5/2008 | Wang et al. | 340/815.45 |
| 2002/0136027 | A1 * | 9/2002 | Hansler et al. | 362/559 |
| 2003/0136837 | A1 | 7/2003 | Amon | |
| 2003/0187742 | A1 | 10/2003 | Yamagishi | |
| 2004/0095777 | A1 | 5/2004 | Trenchard et al. | |
| 2005/0087702 | A1 * | 4/2005 | Ford et al. | 250/504 R |
| 2005/0110649 | A1 | 5/2005 | Fredericks et al. | |
| 2005/0111723 | A1 | 5/2005 | Hannigan et al. | |
| 2006/0082760 | A1 | 4/2006 | Lin | |
| 2006/0083017 | A1 * | 4/2006 | Wang et al. | 362/547 |
| 2006/0250801 | A1 | 11/2006 | Trenchard et al. | |

* cited by examiner

LED SIGNALING APPARATUS WITH INFRARED EMISSION

REFERENCE TO RELATED APPLICATIONS

This application claims an invention which was disclosed in Provisional Patent Application No. 60/767,489, filed Apr. 11, 2006, entitled "Infrared LED Lighting Apparatus for Night Vision Based Navigation", and in Provisional Patent Application No. 60/767,526, filed May 15, 2006, entitled "LED Signaling Apparatus with Infrared Emission". The benefit under 35 USC §119(e) of the above mentioned U.S. Provisional Applications is hereby claimed, and the aforementioned applications are hereby incorporated herein by reference.

FIELD OF THE INVENTION

This invention generally relates to a signaling apparatus, and more specifically to a navigational LED signaling apparatus with infrared emission.

BACKGROUND

Lighting/signaling systems are important navigational aids for aircrafts, boats, or other vehicles, in providing guidance, signaling, and demarcation functions therefore. Semiconductor light emitting devices, preferably light emitting diodes (LEDs), have been identified to be the replacement for the conventional incandescent or electrical discharge lamps that are employed in the current navigational lighting/signaling systems. LEDs offer many advantages over incandescent or electrical discharge lamps. These advantages include but are not limited to high energy efficiency, long lifespan, low maintenance cost, enhanced reliability and durability, as well as no lumen loss induced by filtering.

Visible navigational LEDs are 'cold' light sources that produce less heat or infrared emission than the conventional incandescent lights. However, in certain cases, the infrared emission produced by the incandescent navigational lights is useful. For example, search/rescue teams may use the heat signature of an incandescent lamp in a conventional buoy lantern to locate the stranded crew with their night vision equipments such as night vision goggles (NVGs) or forward looking infrared (FLIR) equipments. When boaters are stranded, they will radio their location referencing particular buoys as the coordinates and the search/rescue team will fly to a location according to those coordinates. During the operation, NVGs or FLIRs are used to search for thermal signatures of boaters under water and in the mean time to see the buoy coordinates which have the infrared emission. As another example, lighting/signaling apparatus with infrared emission may be used for navigation during covert operations.

Infrared LEDs are known to be used as signal beacons and airport runway lighting apparatus.

U.S. Pat. No. 5,804,829 to Palmer describes a portable signal beacon adapted to be worn on the body so as to provide a discernable signal to a remote observer. The signal beacon includes a lightweight housing containing a bank of infrared LEDs. A signal generating device controls the activation of the LED light source and provides the LED light source with one of a plurality of different flashing sequences. The portable design of the disclosed signal beacon is not suitable for permanent or semi-permanent navigational applications where a much higher light intensity is required.

U.S. Pat. No. 7,023,361 to Wallace et al. describes a runway lighting fixture of the type normally permanently installed at an aircraft installation such as an airport to provide visible light signals to an aircraft, the fixture having an internal, non-visible light source such as an infrared lamp capable of being activated to provide a non-visible light signal to an aircraft specially equipped to see such non-visible signals. The lighting fixture comprises a standard incandescent or quartz lamp as the visible light source and an array of infrared LEDs as the non-visible light source. The visible and the non-visible light sources are independently powered and emit from separate light-emitting windows. Due to the fact that the disclosed the lighting fixture still comprises lamp based light sources, it suffers similar disadvantage as conventional lamp based navigational lights.

Neither of the Palmer and Wallace patents discloses an intention to control the beam profile of the LEDs to produce a well defined spatial distribution of light intensity, which is required by many national or international standards, such as FAA, NOAA, ICAO, UK-CAA, and/or NATO standards for navigational lights.

There thus exists a need for an all solid state lighting/signaling apparatus for permanent or semi-permanent navigational applications. The lighting/signaling apparatus produces visible as well as infrared emission with well defined beam profile and intensity distribution for navigation and search/rescue applications employing night vision equipments.

SUMMARY OF THE INVENTION

According to one aspect of the present invention, there is provided a variety of permanent or semi-permanent LED signaling apparatus with infrared emission for night vision based navigation for vehicles such as aircrafts, ships, or other types of vehicles. The LED signaling apparatus produces infrared emission that is bright enough to be seen by a controller of the vehicle (both human and machine based) wearing NVGs, FLIRs or other types of night vision equipments from a suitably long distance away. The intensity of the infrared emission is modulated to produce a distinctive flash pattern to denote the apparatus's navigational function.

According to another aspect of the present invention, the LED signaling apparatus produces both visible emission and infrared emission. The visible emission is used for navigational purposes while the infrared emission is used to emulate the heat signature of incandescent lamps to aid search/rescue actions employing night vision equipments.

The LED signaling apparatus features low power consumption and ruggedness to adapt for harsh environment conditions since it is completely comprised of solid state elements. The LEDs may be powered by rechargeable batteries for quick field deployment.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
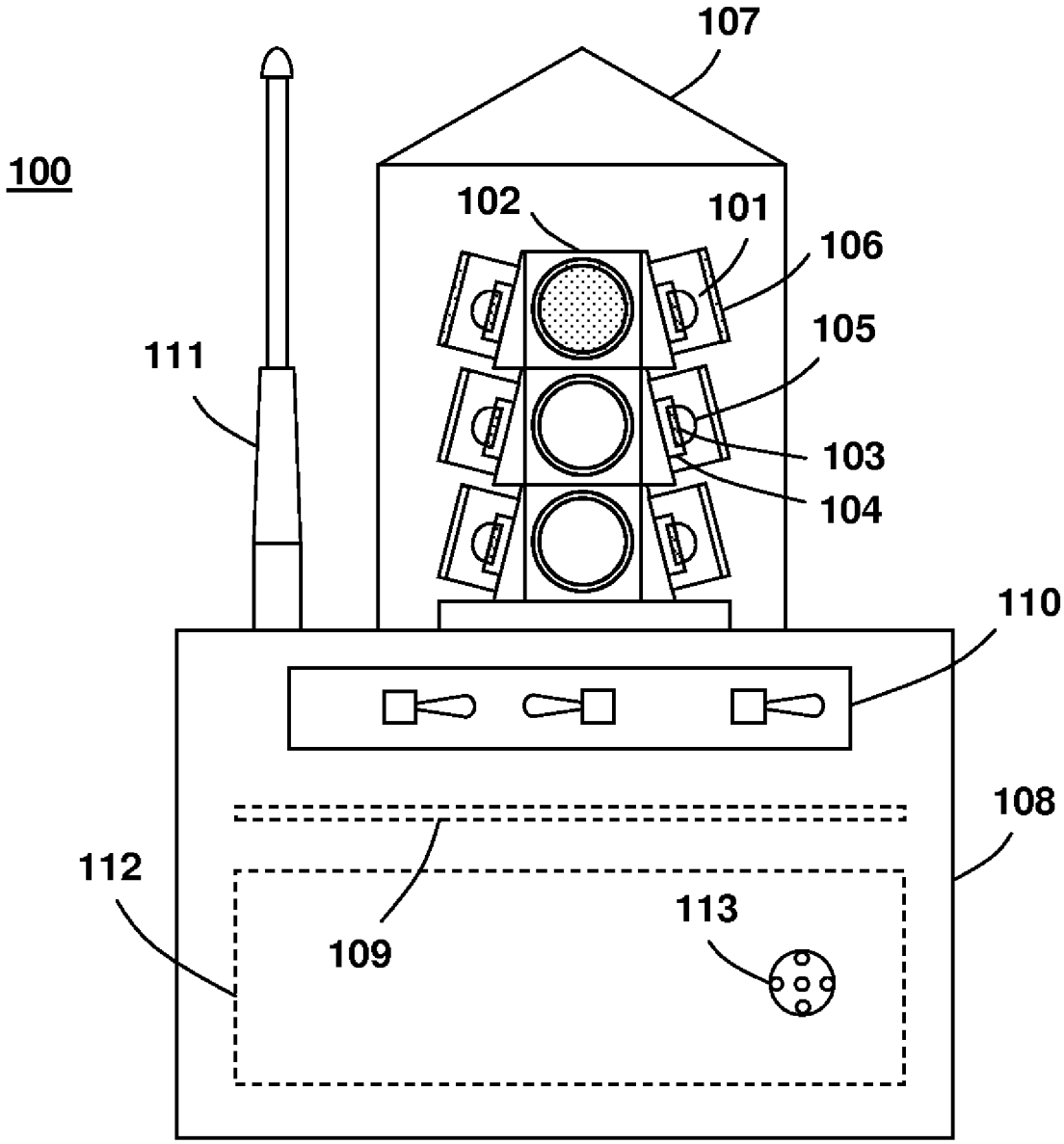
FIG. 1 illustrates an exemplary LED signaling apparatus with infrared emission, which is used as covert navigational aids for airports.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an LED signaling apparatus with infrared emission. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Referring to FIG. 1, an exemplary LED signaling apparatus with infrared emission is disclosed as navigational aids for airports. The navigational signaling apparatus 100 comprises an array of high intensity infrared LEDs 101 mounted on a metal fixture 102, which also serves as a heat sink. Each LED 101 is composed of an LED chip 103, a ceramic or metal substrate 104 for heat dissipation, and a dome lens 105 for LED beam control. The emission wavelength of the LEDs may vary from near infrared to mid infrared, depending on the spectral response of the night vision equipments used in associated with the signaling apparatus 100. For applications that require uniform illumination, a holographic diffuser 106 may be attached in front of the dome lens 105 for beam shaping and homogenization. The LEDs 101 may be arranged in different physical configurations for unidirectional, bidirectional, and/or omnidirectional illumination. The tilt angle of the LEDs 101, which determines the elevation angle of the LED beam, is set according to specific application requirements. For example, when the LED signaling apparatus 100 is used as a precision glide slope indicator (PAPI), the elevation angle of the LED beam should be in a range from 2° to 8°. The infrared LEDs 101 and the associated components are enclosed in a substantially transparent waterproof housing 107. Below the light housing 107 is an electrical compartment 108 that holds the LED drive and control circuit boards 109 and the corresponding electrical wirings. The circuit boards 109 further comprise a microcontroller and a wireless transceiver (both not shown). The intensity, flash pattern, and on/off status of the LED array 101 can be controlled either manually by a set of switches 110 or automatically through wireless communication with a remote control office via the wireless transceiver and an antenna 111. The lighting apparatus 100 can be driven by constant-current power supply which is the standard for current airport lighting systems, or by regular AC/DC power, or by a battery 112 rechargeable through a charging port 113. Airfield navigational lights based on visible LEDs with similar structures can be found in U.S. patent application Ser. Nos. 11/382,078, 11/457,528, and 11/622,234 commonly assigned to the same assignee.

The structural design of the disclosed LED signaling apparatus is especially optimized to produce a high light intensity with well defined intensity distribution. First, the metal fixture 102 and the ceramic or metal substrate 104 provide good or sufficient heat dissipation for the LED chips 103, thus allowing the LEDs 101 to operating at high drive currents to produce high output power. Second, the light beam of each LED is individually controlled by corresponding optical components. This approach provides light beams whose intensity distribution can be precisely controlled to meet the requirement of navigational standards.

In a slight variation of the present embodiment, both visible and infrared LEDs can be incorporated into the same module to construct a dual-usage navigational apparatus. The visible LEDs are used for common navigations while the infrared LEDs are used for covert navigations such as for military actions.

Figure 2:
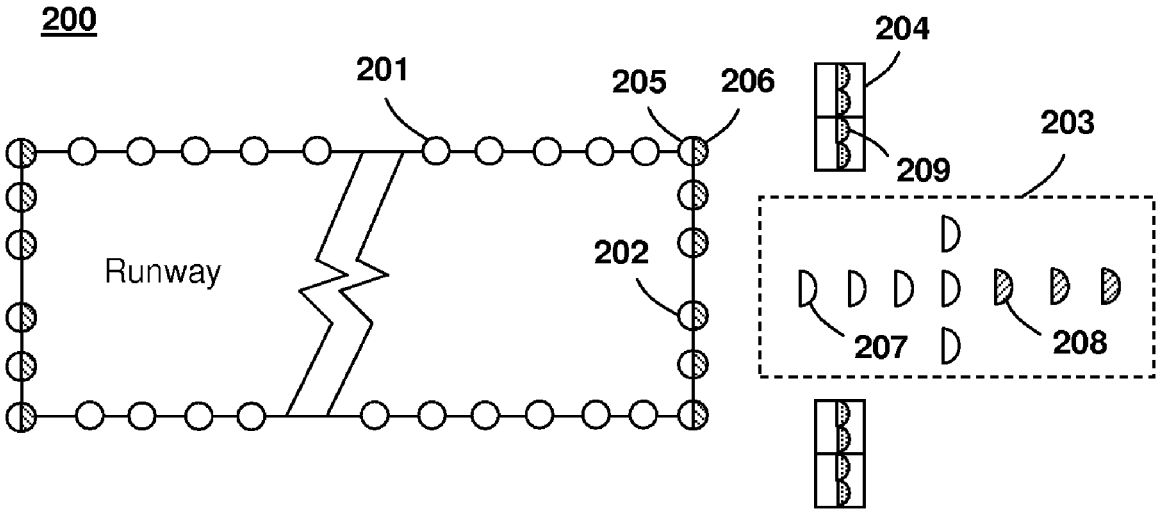
FIG. 2 illustrates an airfield signaling system constructed with the LED signaling apparatus disclosed in FIG. 1.

FIG. 2 illustrates an airfield signaling system 200 constructed with the infrared LED signaling apparatus disclosed in FIG. 1. The airfield signaling system 200 comprises omnidirectional runway edge lights 201, bidirectional runway threshold lights 202, unidirectional approach lights 203, and unidirectional precision approach path indicators (PAPIs) 204. The omnidirectional runway edge light 201 comprises steady-burning LEDs that are covered with holographic diffusers for beam expansion and homogenization. The LEDs are arranged with different angular orientations in the horizontal plane to form a 360° omnidirectional illumination. The bidirectional runway threshold light 202 comprises one group of steady-burning LEDs 205 and one group of flashing LEDs 206, each collimated to provide directional illumination in a small solid angle. The flashing LEDs 206 denote the direction where an aircraft enters the runway. The unidirectional approach lights 203 consist of steady-burning LEDs 207 and flashing LEDs 208, both are tilted to an elevation angle matching with the glide-slope of landing aircrafts. The PAPI 204 comprises four LED modules 209, each consisting of one steady-burning LED array and one flashing LED array to produce two vertically adjacent LED beams. The LED beams are both collimated for unidirectional illumination oriented toward the same direction. The elevation angle of the LED beams is utilized to indicate the correct glide slope. Incoming aircrafts are guided toward and into the correct glide slope by following a narrow transition zone between the steady-burning and the flashing LED beams. The runway threshold lights 202, the approach lights 203, and the PAPIs 204 are distinguished by their different flash patterns.

Figure 3:
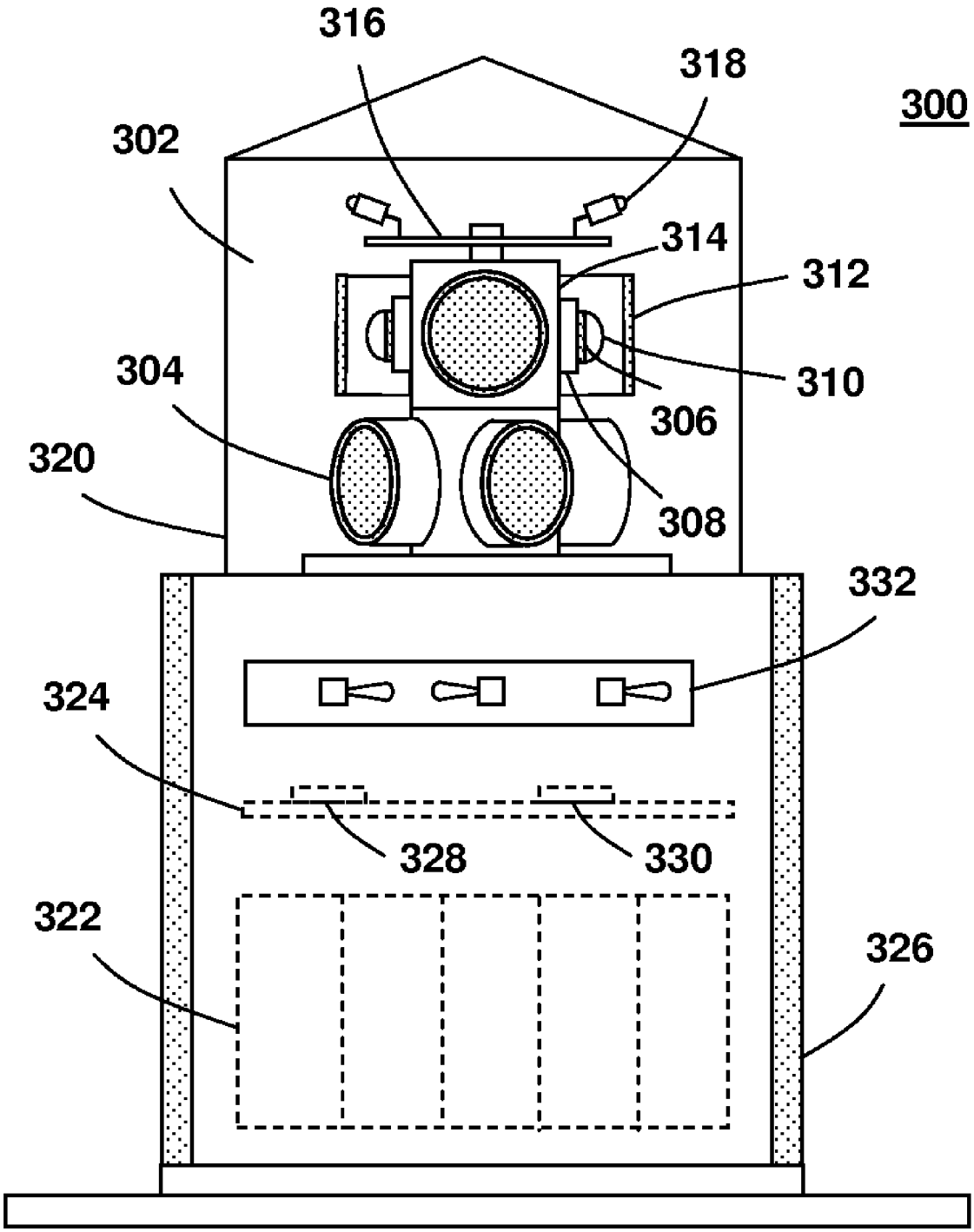
FIG. 3 illustrates a self-contained LED buoy lantern for maritime navigation. The lantern comprises infrared emission elements to aid search/rescue actions employing night vision equipments.

In yet another embodiment of the present invention as shown in FIG. 3, an LED signaling apparatus 300 is used as a self-contained buoy lantern for maritime navigation. The optical head 302 of the buoy lantern 300 comprises twelve high intensity visible LED units 304 mounted in two stacks with a first stack positioned on top of the second stack. Each stack comprises six visible LED units separated by sixty degrees (60°) angularly in the horizontal plane. An angular offset of thirty degrees (30°) may be introduced between the two LED stacks for more uniform illumination. The visible LED unit 304 comprises a surface mounted, or in other words, chip-on-board (COB) packaged high power LED chip 306 mounted on a heat sink 308. A dome lens 310 is used to collect and collimate the light emission from the LED chip 306. A thin film holographic diffuser 312 may be positioned in the path of the LED light for beam homogenization and divergence angle control. All the visible LED units 304 are mounted circumferentially on the outer side of a hexagonal shaped aluminum cylinder 314 for heat dissipation. On top of the aluminum cylinder 314 is a small circuit board 316, which drives six infrared LED units 318, each separated by sixty degrees (60°) angularly in the horizontal plane. The infrared LED units 318 produce an omnidirectional infrared emission to emulate the heat signature of an incandescent lamp, which is used as aids for search and rescue employing night vision goggles (NVGs). The emission wavelength of the infrared LED units 318 is optimized to match with the response wavelength of the NVGs. The tilt angle of the infrared LED units 318 is designed to match with the view angle of a pilot on a rescue aircraft. The infrared LED units 318 may further comprise holographic diffusers (not shown) for beam homogenization and divergence angle control.

Both visible LEDs 304 and infrared LEDs 318 are enclosed in a waterproof transparent housing 320 and powered by a group of rechargeable batteries 322 through a main control circuit board 324 connected with the small circuit board 316. The rechargeable batteries 322 are further powered by a group of solar panels 326 converting solar energy into electrical energy. The rechargeable batteries 322 are positioned on the side of the buoy lantern 300, enabling the same to operate without external electrical power supplies. The main circuit board 324 further comprises a microcontroller 328 and a wireless transceiver 330 for such purposes as remote control of the LED units 304 and 318. The intensity, flash pattern and on/off status of the LED units 304 and 318 can be controlled independently either by a set of switches 332 or by wireless communication through the microcontroller 328 and the wireless transceiver 330. The LED units may either be controlled by the boaters or the rescue teams to assist the search and rescue action. For example, when a boat is stranded near the buoy lantern 300, the boater may produce a special flash pattern representing call for help signal through the infrared LED units 318 so that the position of the boat can be easily located by rescue teams wearing NVGs. Since the visible LED units 304 and the infrared LED units 318 can be controlled independently, the normal navigational function of the buoy lantern 300 will not be influenced.

In a slight variation of the present embodiment, other type of infrared emitting devices other than LEDs, such as heating elements or lasers, may be incorporated into the LED signaling apparatus to provide infrared emission which can be observed by observers wearing FLIRs or thermal imagers.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An infrared light emitting diode (LED) signaling apparatus used in connection with night vision equipments for navigational applications, the signaling apparatus comprising:

a plurality of high intensity infrared LEDs mounted on a heat conductive support member to produce a plurality of infrared emissions; whereby said support member controls a spatial orientation of each of said plurality of infrared emissions;

a set of optical components with each component coupled to an associated LED among said plurality of infrared LEDs to control a divergence angle and an intensity distribution of each of said plurality of infrared emissions such that said plurality of infrared emissions combine in a free space according to said spatial orientation, divergence angle, and intensity distribution to produce a predetermined illumination pattern; and electronic circuits associated with each of said plurality of infrared LEDs to control a set of parameters of said plurality of infrared emissions.

2. The signaling apparatus of claim 1, wherein a flash pattern of said plurality of infrared emissions is utilized to denote a usage of the signaling apparatus.

3. The signaling apparatus of claim 1, further comprising at least one battery operable for supplying power to the signaling apparatus.

4. The signaling apparatus of claim 3, wherein said battery comprises a rechargeable battery.

5. The signaling apparatus of claim 1, wherein said set of parameters comprises on/off status, intensity, and flash pattern of said plurality of infrared emissions.

6. The signaling apparatus of claim 1, further comprising heating elements or lasers in addition to said plurality of infrared LEDs to produce infrared emission.

7. The signaling apparatus of claim 1, wherein said optical components comprise optical lenses.

8. The signaling apparatus of claim 1, wherein said optical components comprise holographic optical diffusers.

9. An LED signaling apparatus used for both navigational and search/rescue applications, the signaling apparatus comprising:

a plurality of high intensity visible LEDs and a plurality of high intensity infrared LEDs mounted on a heat conductive support member to produce a plurality of visible emissions and a plurality of infrared emissions, respectively; whereby said support member controls a spatial orientation of each of said plurality of visible and infrared emissions;

a set of optical components with each component coupled to an associated LED among said plurality of visible and infrared LEDs to control a divergence angle and an intensity distribution of each of said plurality of visible and infrared emissions such that said plurality of visible and infrared emissions combine in a free space according to said spatial orientation, divergence angle, and intensity distribution to produce a predetermined illumination pattern; and electronic circuits associated with each of said plurality of visible and infrared LEDs to control a set of parameters of said plurality of visible and infrared emissions; whereby said plurality of visible LEDs are used for common navigational aids and said plurality of infrared LEDs are used for night vision based navigational aids.

10. The signaling apparatus of claim 9, wherein a flash pattern of said plurality of infrared emissions or visible emissions is utilized to denote a usage of the signaling apparatus.

11. The signaling apparatus of claim 9, further comprising at least one battery operable for supplying power to the signaling apparatus.

12. The signaling apparatus of claim 11, wherein said battery comprises a rechargeable battery.

13. The signaling apparatus of claim 9, wherein said set of parameters comprises on/off status, intensity, and flash pattern of said plurality of infrared and visible emissions.

14. The signaling apparatus of claim 9, further comprising heating elements or lasers in addition to the plurality of infrared LEDs to produce infrared emission.

15. The signaling apparatus of claim 9, wherein said optical components comprise optical lenses.

16. The signaling apparatus of claim 9, wherein said optical components comprise holographic optical diffusers. optical lenses.

17. A method for producing and using an LED signaling apparatus for both navigational and search/rescue applications, the method comprising the steps of:

providing a plurality of high intensity visible LEDs and a plurality of high intensity infrared LEDs mounted on a heat conductive support member to produce a plurality of visible emissions and a plurality of infrared emissions, respectively; whereby said support member controls a spatial orientation of each of said plurality of visible and infrared emissions;

providing a set of optical components with each component coupled to an associated LED among said plurality of visible and infrared LEDs to control a divergence angle and an intensity distribution of each of said plurality of visible and infrared emissions such that said plurality of visible and infrared emissions combine in a free space according to said spatial orientation, divergence angle, and intensity distribution to produce a predetermined illumination pattern; and providing electronic circuits associated with each of said plurality of visible and infrared LEDs to control a set of parameters of said plurality of visible and infrared emissions; whereby said plurality of visible LEDs are used for common navigational aids and said plurality of infrared LEDs are used for night vision based navigational aids.

18. The method of claim 17, wherein a flash pattern of said plurality of infrared emissions or visible emissions is utilized to denote a usage of the signaling apparatus.

19. The method of claim 17, further comprising the step of providing at least one battery operable for supplying power to the signaling apparatus.

20. The method of claim 19, wherein said battery comprises a rechargeable battery.

21. The method of claim 17, wherein said set of parameters comprises on/off status, intensity, and flash pattern of said plurality of infrared and visible emissions.

22. The method of claim 17, further comprising the step of providing heating elements or lasers in addition to the plurality of infrared LEDs to produce infrared emission.

23. The method of claim 17, wherein said optical components comprise optical lenses.

24. The method of claim 17, wherein said optical components comprise holographic optical diffusers.

* * * * *